United States Patent [19]

Simmons

[11] 4,120,013

[45] Oct. 10, 1978

[54] LAUNDRY MACHINE CONTROL SYSTEM

[75] Inventor: James W. Simmons, Arlington, Tex.

[73] Assignee: Ametek, Inc., New York, N.Y.

[21] Appl. No.: 781,650

[22] Filed: Mar. 28, 1977

[51] Int. Cl.[2] ..... D06F 37/42

[52] U.S. Cl. ..... 361/180; 68/12 R; 361/236

[58] Field of Search ..... 68/12 R, 139; 307/120, 307/328; 361/180, 236, 240, 241

[56] References Cited

U.S. PATENT DOCUMENTS 3,328,983 7/1967 Brucken et al. ..... 68/12 R

FOREIGN PATENT DOCUMENTS 2,318,363 10/1974 Fed. Rep. of Germany ..... 68/12 R

*Primary Examiner*—Harry E. Moose, Jr.

*Attorney, Agent, or Firm*—Hubbard, Thurman, Turner, Tucker & Glaser

[57] ABSTRACT

A control system for a laundry machine generates a control signal to operate a door lock unit and prevent the door from opening while the laundry machine cylinder is rotating. A permanent magnet is mounted adjacent to the drive wheel of the cylinder so that the wheel spokes cut through the magnetic field of the magnet. A pick-up coil is mounted coaxial with the magnet and generates an induced pulse signal as the wheel turns. The induced pulse signal is processed by circuitry mounted on a printed circuit board to generate a DC control signal for the door unlocking circuitry of the door lock unit. The pulse signal is rectified and smoothed to provide a DC signal and is processed by a timer circuit to provide an amplified, precise switching signal which is used as the control signal. The DC control signal operates an electronic switch which connects an AC power source across a relay coil to open the door unlocking circuit so that the door remains locked as long as the DC control signal is generated. A separate extract circuit is simultaneously closed by the relay so that the extract unit can be actuated by the drum timer during the washing cycle only when a control signal is generated. If the control system malfunctions, the machine cannot switch into its high-speed extract cycle. A capacitor maintains the DC control signal at the input of the electronic switch for a predetermined period of time after the induced voltage has stopped to keep the door locked until the rotating cylinder has come to a complete stop.

15 Claims, 6 Drawing Figures

LAUNDRY MACHINE CONTROL SYSTEM

BACKGROUND OF THE INVENTION

The present invention relates to a laundry machine control system and more particularly to a system for sensing the rotation of a laundry machine cylinder to generate a control voltage for a door locking unit.

In the past, many accidents have occurred by a user opening the door of a laundry machine while it is in operation. To prevent such accidents, special electrical door lock mechanisms have been devised, such as that shown in U.S. Pat. No. 3,243,977, to automatically maintain the laundry machine door locked during the operation until the entire washing cycle had been completed or a premature shutdown occurs.

Prior art systems for generating the necessary control voltage to operate such a door lock have been expensive and complicated. In one such system, a self-contained DC generator is mechanically connected to the rotating axis of the laundry cylinder to generate the necessary DC voltage by direct mechanical linkage with the axle. This approach requires a number of moving parts as well as considerable time and expense in connecting the necessary linkage to the rotating axle. Another system uses a plugging switch with a mechanical connection to the cylinder shaft which senses rotation and bends a contact by magnetic force to open or close a switch to actuate or deactuate a control circuit. Such a system is relatively expensive and complicated and is generally not sufficiently reliable and precise for continued long-term use.

SUMMARY OF THE INVENTION

The present invention provides a magnetic sensing assembly which can be easily attached adjacent to the hub of a rotating axle of a laundry machine. The magnetic assembly is mounted with a permanent magnet adjacent to the drive wheel to enable the drive wheel spokes to cut through the magnetic field as they move past the magnet. A pick-up coil is mounted coaxial with the magnet and generates an induced voltage as the wheel turns and varies the flux. Circuitry mounted on a printed circuit board adjacent to the magnetic assembly rectifies and smooths the induced voltage to provide a DC signal. The DC signal is then fed to a timer circuit which generates a precise amplified DC output signal for operating an electronic switch. The switch selectively connects an AC operating voltage across a relay coil in response to the DC output signal, and the relay coil opens and closes a switch to actuate or deactuate the door unlocking circuitry. A delay circuitry is included for maintaining the DC output signal for a predetermined period of time after the induced voltage ceases so that the door lock mechanism remains activated until the rotating cylinder has come to a complete stop.

In accordance with another aspect of the present invention, a system is provided for controlling a door lock to allow access to a rotatable cylinder only with the cylinder stationary. A magnetic unit has a magnetic field and an induction coil for sensing the movement of the cylinder to induce a pulse signal in the coil. Electrical circuitry is in electrical communication with the magnetic unit and is provided to amplify the pulse signal and convert the signal to a DC control signal. A delay circuit maintains the DC control signal for a predetermined period of time after the pulse signal has ceased. A switching mechanism is responsive to the DC control signal to actuate and deactuate the cylinder door lock to control access to the rotatable cylinder.

In accordance with another aspect of the present invention, a system generates a control signal in response to motion by a movable magnetizable member. A permanent magnet is mounted on stationary structure which is in magnetic communication with the movable member. The permanent magnet is mounted adjacent to the movable member so that the member cuts across the magnetic field as it moves. A pick-up coil is mounted on the structure coaxial with the magnet to generate an induced voltage as the movable member cuts through the magnetic field and varies the flux. A circuit in electrical communication with the pick-up coil converts the induced voltage to a control voltage using a multiple-state memory device to provide continuous output and a delay circuit to extend the continuous output for a predetermined time period after the induced voltage ceases.

A further aspect of the present invention is concerned with a system for operating a relay to control a laundry machine door lock. The machine includes a rotatable cylinder having a drive wheel with multiple spokes radiating from a common hub. Magnetic means is mounted in magnetic communication with the wheel for sensing motion and the wheel and inducing a pulse signal in response to motion of the wheel. A control circuit responds to the pulse signal of the magnetic means to generate a control signal. Electronic switching means in electrical communication with the control circuitry actuates the door lock in response to the pulse signal.

In accordance with yet another aspect of the present invention, a circuit is provided for converting an AC signal to a DC control signal for operating a relay. A conversion circuit rectifies and smooths the AC input signal to provide a steady state signal. A transistor circuit turns a timer circuit off and on in response to the presence or absence of the steady state signal. The timer circuit generates a digital control signal in response to the steady state signal. A switching circuit is responsive to the control signal to impress a power source across the relay. A control circuit maintains the control signal at input of the switching circuit for a predetermined period of time after the AC input signal has stopped.

A further aspect of the present invention involves a control system for a laundry machine having a rotatable cylinder, an electrical door lock and an electrical circuit for controlling the high-speed cycle of the cylinder which extracts water from the laundry. A magnetic unit senses rotation of the cylinder and generates a sensing signal. A control circuit in electrical communication with the magnetic unit generates a control signal in response to the sensing signal. An electronic switching circuit in electrical communication with the control circuit actuates the door lock and the extract circuit only in response to the control signal.

The invention as described above has several important advantages over the prior art. Since the system of the present invention has no moving parts, installation and maintenance of the system is greatly simplified. The system of the present invention also provides a unit which is considerably less expensive than prior art systems. The permanent magnet and pick-up coil may be easily assembled and attached adjacent to the wheel of any different type of laundry machine without concern for compatible mechanical parts. The circuitry of the present invention lends itself easily to a printed circuit board design including the use of integrated circuit components to provide an extremely compact, easily fabricated unit. The door can be unlocked only when the laundry cylinder has come to a complete stop, preventing potential injury to machine users. Moreover, should the control circuit fail, a user of the laundry machine is further protected since the cylinder cannot begin its high-speed extract cycle.

The novel features which characterize the invention are defined in the appended claims. The foregoing and other objects, advantages and features of the invention will hereinafter be described, and for purposes of illustration of the invention but not of limitation, exemplary embodiments of the invention are shown in the appended drawings.

DETAILED DESCRIPTION OF THE DRAWINGS

Figure 1:
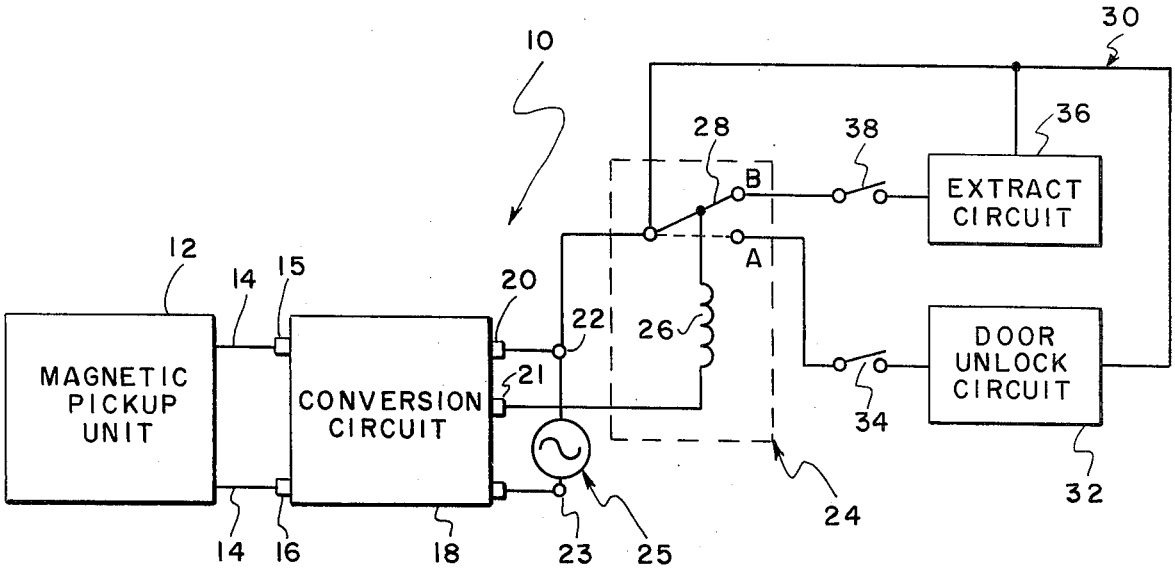
FIG. 1 is a block diagram of the laundry machine control system of the present invention.

Referring now to FIG. 1, a block diagram of the automatic locking system 10 of the present invention is shown. System 10 is preferably mounted on a laundry machine such as a commercial washer and extractor. However, the system of the present invention is useful in other applications requiring the generation of a control signal for restricting access to a rotating cylinder or other moving device.

A magnetic pick-up unit 12 generates an electrical output on lines 14 in response to movement of the laundry machine cylinder. The electrical pulse is fed to the inputs 15 and 16 of a conversion circuit 18. Circuit 18 transforms the input AC pulse signal to a precise DC control signal which is amplified and provided to output terminals 20 and 21. Terminals 22 and 23 supply power from a 110 volt AC source 25 to circuitry 18 and, selectively, to the output load across terminals 20 and 21.

Output terminals 20 and 21 are connected to a conventional external relay 24 having an actuable coil 26 operating a switch 28. Switch 28 is actuable between positions A and B to energize and de-energize certain parts of control circuitry 30. Switch 28 is non-actuated in position A to close a door unlock circuit 32 and enable the cylinder door to be opened with the cylinder at rest. A stop switch 34 on a conventional drum timer (not shown) is provided to automatically prevent the door from unlocking with the cylinder stopped at certain times during the cycle, such as when the cylinder is filled with washing fluid.

Switch 28 is actuated and moves to position B when the cylinder is rotating. In this position, an extract circuit 36 is closed and a door unlock circuit 32 is de-energized to keep the laundry machine door locked shut during operation. The extract circuit 36 is energized when a secondary extract switch 38 on the drum timer is closed.

Since the extract circuit 36 can only be energized when a signal is generated by unit 12, the laundry machine cylinder cannot run in the high-speed extract mode if system 10 fails. The door unlock circuit 32 and the extract circuit 36 are both conventional systems common to commercial laundry machines, and further disclosure in the present application is unnecessary.

Figure 2:
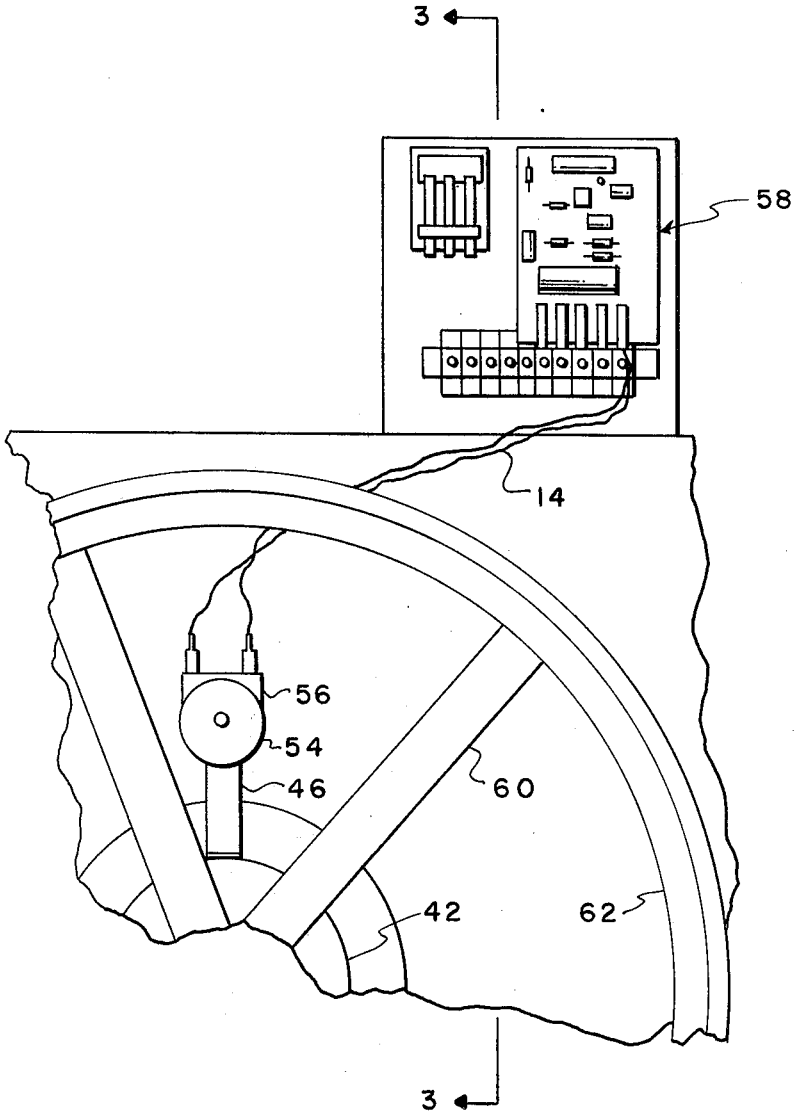
FIG. 2 is a front elevation view of a portion of a laundry machine showing the mounting and configuration of the system for the present invention.
Figure 3:
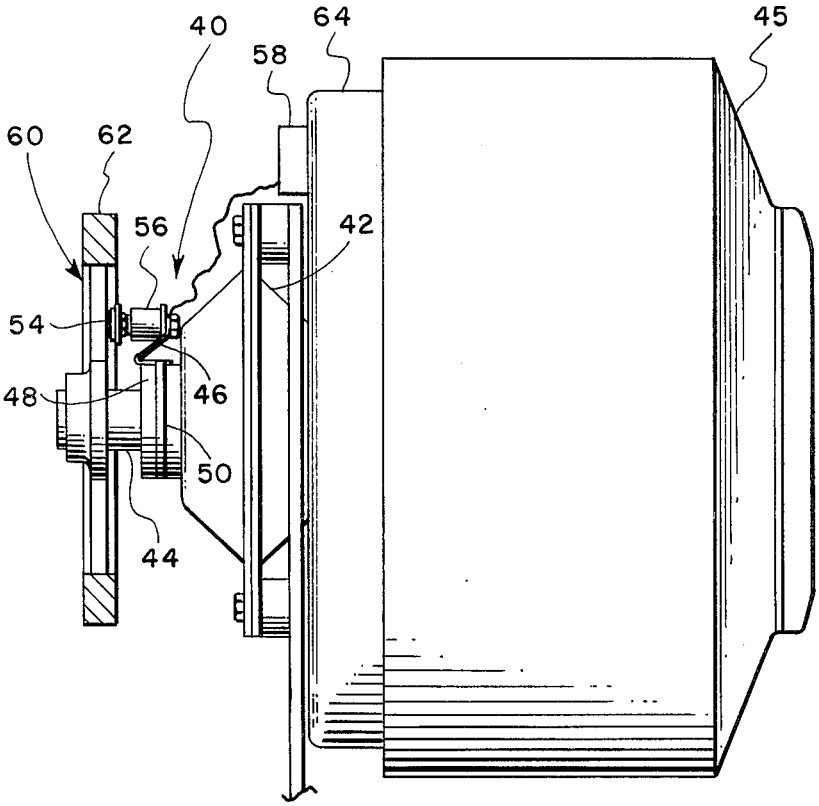
FIG. 3 is a partial cross-sectional view of the portion of the laundry machine shown in FIG. 2.
Figure 4:
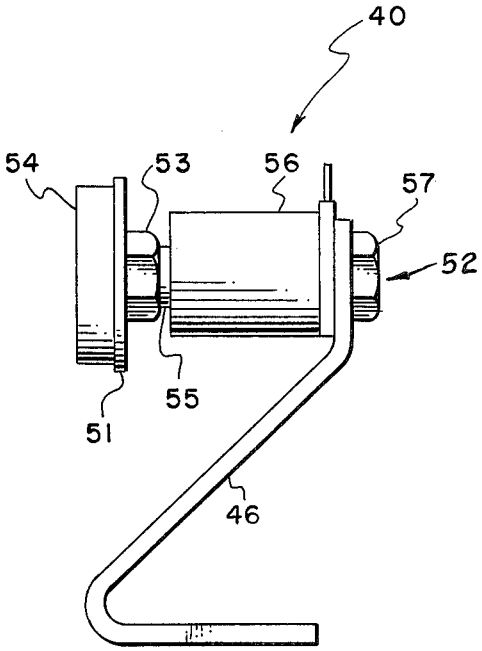
FIG. 4 is a blown-up side elevation view of the magnetic spoke sensor assembly shown in FIG. 2.

Referring now to FIGS. 2, 3 and 4 the preferred structure of magnetic pick-up unit 12 is shown together with the location of pick-up unit 12 and conversion circuitry 18 on a laundry machine. Pick-up unit 12 is preferably a magnetic spoke sensor assembly 40 mounted on a bearing housing 42. The housing surrounds an axle 44 which drives a laundry cylinder 45. Spoke sensor assembly 40 includes an angled member 46 mounted on the rear portion 48 of bearing housing 42 using a hose clamp 50.

Spoke sensor asembly is better seen in FIG. 4. A nut-and-bolt assembly 52 is connected at one end to angled member 46 and has a cylindrical permanent magnet 54 attached to the other end. A cylindrical magnetic pick-up coil 56 is mounted on the nut-and-bolt assembly 52 adjacent permanent magnet 54.

Permanent magnet 54 is preferably a ceramic magnet having a circular shape with approximately a $1\frac{1}{8}$ inch diameter. Magnet 54 is mounted on a washer 51 which in turn is welded to a nut 53 attached to a $\frac{3}{8}$ inch bolt 55. Magnetic pick-up coil 56 is preferably a 900 ohm, 120 volt, two lead coil mounted concentrically about bolt 55. Angled member 46 is preferably a soft iron bracket bent at approximately a 135° angle and having bolt 55 attached to one end by a nut 57.

Spoke sensor assembly 40 is mounted on bearing housing 42 with permanent magnet 54 immediately adjacent to the spokes 60 of a main drive sheave 62. Preferably the space between the outer face of magnet 54 and each adjacent spoke 60 is about 1/16 inch. Conversion circuit 18 comprises a printed circuit board 58 mounted on the control panel 64 in the interior of the laundry machine housing. Electrical leads 14 extend from pick-up coil 56 to the input of printed circuit board 58.

Figure 5:
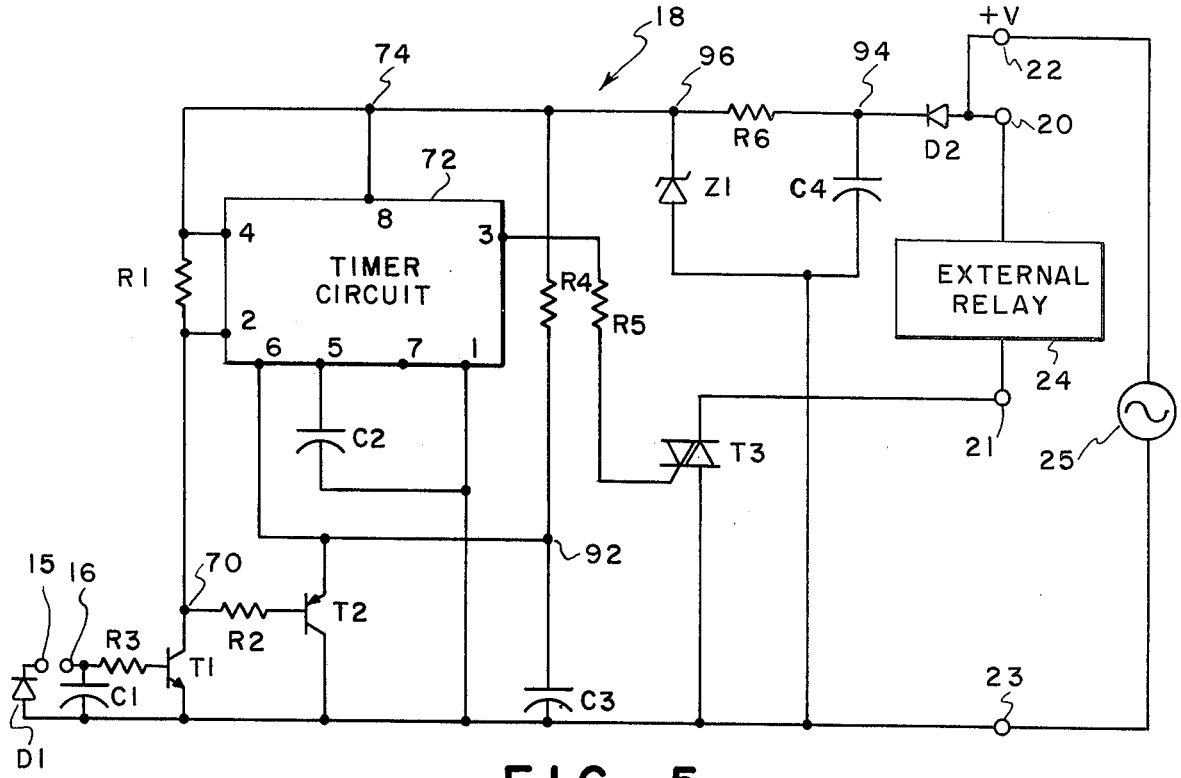
FIG. 5 is a circuit diagram of the electrical conversion circuit shown in FIG. 1.

With reference now to FIG. 5, the circuit diagram for conversion circuit 18 is shown. Input terminals 15 and 16 receive the input pulse from pick-up coil 56 for circuitry 18. Lead 15 is connected to the output of a rectifier diode D1, the input of which is connected to ground. Input terminal 16 leads to one side of a capacitor C1, the other side of which is also connected to ground. Input terminal 16 is also connected through a resistor R3 to the gate of an n-p-n transistor T1. Transistor T1 is connected in a common-emitter configuration with the emitter at ground and the output at the collector which is connected to a node 70.

A p-n-p transistor T2 is gate-connected to node 70 through a resistor R2. The collector of T2 is connected to ground and the emitter output at node 92 is connected to a trigger terminal 6 of a timer circuit 72. Node 70 is also connected to circuit 72 at a set terminal 2. A resistor R1 is connected between node 70 and a second node 74 which is common to terminals 4 and 8 of circuit 72.

Figure 6:
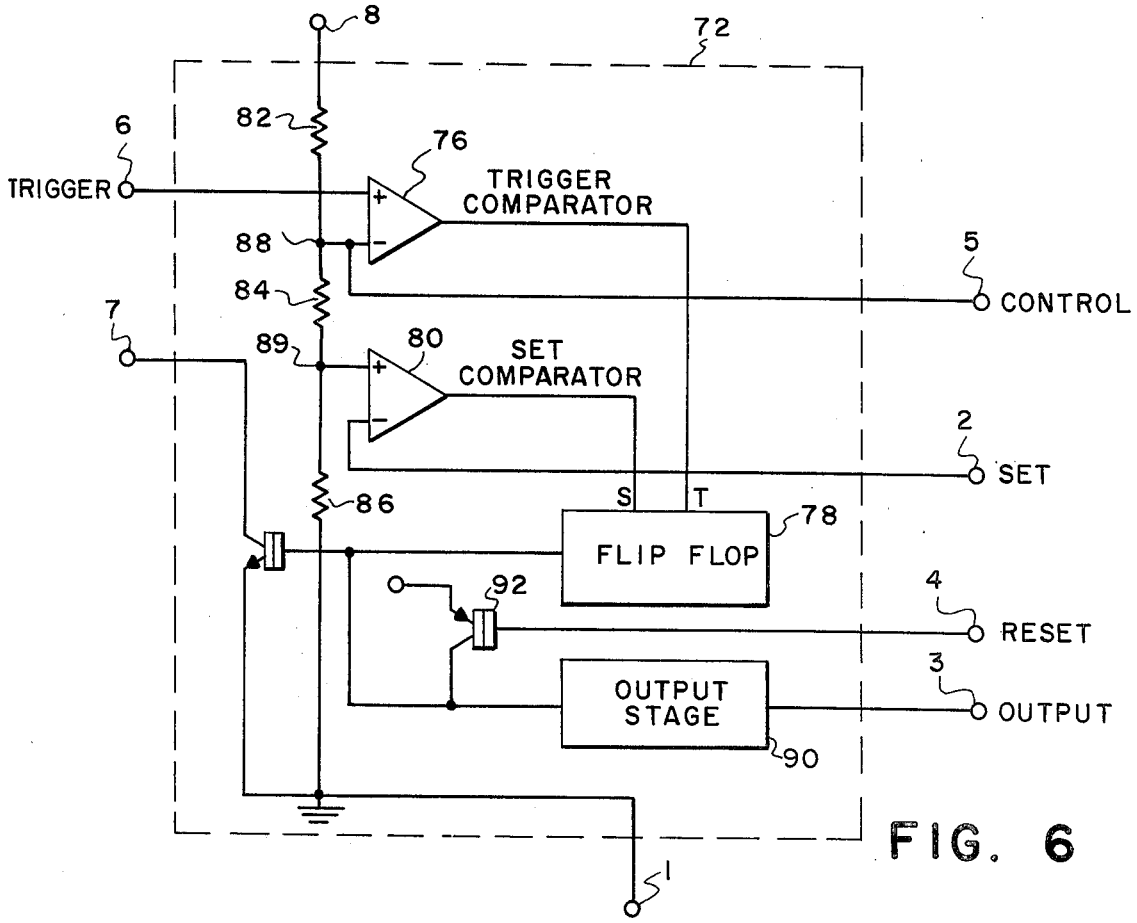
FIG. 6 is a circuit diagram of the timer circuit shown in FIG. 5.

Circuit 72 is a conventional timer circuit which is shown in detail in FIG. 6 to provide a clearer understanding of the operation of the present system. Circuit 72 provides a flip-flop circuit which has a precise steady output for use as a control signal. Circuit 72 also provides sufficient current amplification to operate triac T3.

Trigger terminal 6 leads to the positive input of a trigger comparator 76 having an output feeding into the trigger input of a flip-flop circuit 78. The set input of flip-flop circuit 78 is provided by a set comparator 80 having its negative input from set terminal 2. A voltage divider circuit is biased at input terminal 8 with a regulated voltage at node 74. Three equal-value resistors 82, 84, and 86 are connected in series between terminal 8 and ground forming a first node 88 between resistors 82 and 84 and a second node 89 between resistors 84 and 86. Node 88 provides the negative input for trigger comparator 76, and node 89 provides the positive input for set comparator 80. The output of flip-flop circuit 78 feeds to an output-stage amplifier 90 which in turn provides the output signal at terminal 3. The output of flip-flop 78 is also connected to a reset transistor 92 having its gate connected to a reset terminal 4. In this particular configuration, reset terminal 4 and terminal 7 are not used, and terminal 1 provides the neutral or ground connection for timer circuitry 72. The control voltage input 5 is also connected through a capacitor C2 to ground to filter out any undesired radio frequencies.

Input trigger terminal 6 of timer 72 is connected to node 92 between a charging capacitor C3 leading to ground and a resistor R4 leading to the regulated voltage node 74. The output terminal 3 of timer circuitry 72 is connected through a resistor R5 to the input of a triac T3 which in turn is connected between one output terminal 21 and common terminal 23. Output terminals 20 and 21 are connected across the coil 26 of external relay 24 as previously discussed.

Output terminal 20 is also connected to input terminal 22 to provide a power supply to circuitry 18 from AC power source 25 connected between terminal 22 and ground terminal 23. Input terminal 22 is connected through diode D2 to the input node 94 of a voltage regulator circuitry consisting of a resistor R6, a zener diode Z1 and a capacitor C4. Node 94 is connected in common with one terminal of resistor R6 and one terminal of capacitor C4. The other terminal of capacitor C4 is connected to ground terminal 23 in common with the input terminal of zener diode Z1. The output terminal of diode Z1 is connected to the other side of resistor R6 which is common with biasing voltage node 74.

The printed circuit board 58 is preferably a conventional epoxy glass board having copper terminals and tin interconnecting leads. The resistors of circuitry 18 preferably have values as follows: R1—10K ohms, R2—30K ohms, R3—1K ohm, R4—4.3M ohms, R5—470 ohms and R6—8K ohms. All resistors are preferably ½ or ¼ watt, 5 percent carbon elements, except for resistor R6 which is preferably a 5 watt unit. The capacitor values are preferably as follows: C1—200 microfarads, C2—0.1 microfarads, C3—2.2 microfarads and C4—12 microfarads. The diodes, transistors, triac and zener diode are all conventional components. The timer circuitry 72 is preferably a NE 555 integrated circuitry chip made by Signetics to provide about 2000 milliamps to operate triac T3.

In operation, with the laundry cylinder 45 at rest initially, no induced pulse signal is presented to circuitry 18. The power source 25 is preferably 110 volts AC across terminals 22 and 23 and is reduced to approximately 6.2 volts DC at node 74. Capacitor C3 is charged to approximately 6 volts, and reference voltages of 4 volts and 2 volts are present at nodes 88 and 89 respectively. Transistors T1 and T2 are turned off so that the inputs at set terminal 2 and trigger terminal 6 of timer circuit 72 are both approximately 6 volts. In this state, trigger comparator 76 is turned on and set comparator 80 is turned off so that the output of flip-flop circuit 78 is zero. Since there is no ouput at terminal 3, triac T3 is off and external relay 24 is not actuated. The door unlock circuit is closed, enabling access to the laundry cylinder.

As the cylinder 45 begins to rotate, the spokes 60 of sheave 62 pass through the magnetic field of permanent magnet 54 causing a variation in flux which induces a voltage in pick-up coil 56. The induced voltage in the form of a pulse signal is transmitted on leads 14 to the input terminals 15 and 16 of printed circuit board 58. The capacitor C1 smooths out each pulse, and diode D1 rectifies the pulse signal to a DC steady-state signal which is presented at the gate of transistor T1 to turn it on and drop node 70 to ground. Transistor T2 is also turned on, dropping node 92 to ground and discharging capacitor C3.

With transistors T1 and T2 both simultaneously turned on, the input voltage is low on terminals 2 and 6 of timer circuit 72. This change causes the output of trigger comparator 76 to go negative and the output of set comparator 80 to go positive, thereby providing a positive output signal from flip-flop circuit 78. This output signal is amplified by output stage 90 to a value sufficient to turn on triac T3. This action drops terminal 21 to ground to place the 110 volt source across relay 24 and activate relay coil 26. Switch 28 moves to position B and opens the door unlock circuit 32, preventing the door from being opened while the cylinder is turning. Also, in position B, the extract circuit 36 is closed to enable the extract unit when the switch 38 on the drum timer is actuated.

When the laundry machine shuts off, several seconds are required before the cylinder has slowed down and stopped turning. It is imperative that the door to the laundry cylinder remain locked during this time to prevent premature access to the cylinder causing injury to the user. The spoke sensor assembly 40 will continue to provide a control signal to maintain the door locked until sheave 62 has slowed substantially. However, as the rotational speed of the cylinder slows, the change in magnetic flux lessens so that eventually an insufficient voltage is induced in pick-up coil 56 to provide the necessary control signal at terminals 15 and 16 of conversion circuitry 18. Since it is important to keep the laundry door locked until the cylinder has completely stopped, capacitor C3 is provided to extend the output signal to the relay circuit 24 for a certain predetermined time past the time when the input signal ceases from coil 56.

As the input pulse ceases, T1 and T2 are both turned off causing node 70 to rise to about 6 volts so that the output of set comparator 80 turns negative. The state of flip-flop 78 does not change since the input terminal 6 is temporarily maintained low by capacitor C3. Thus, the output of trigger comparator 76 remains negative. Since T2 is turned off, capacitor C3 begins to charge through resistor R4 toward the biasing voltage of 6.2 volts, raising node 92 with it. After approximately 12 seconds capacitor C3 has charged sufficiently to turn the output of trigger comparator 76 positive and change the state of flip-flop 78 to zero. Triac T3 is turned off which deactivates external relay circuit 24 and closes the door unlock circuit 32. Thus, until the capacitor C3 has charged sufficiently to change the output of flip-flop 78, the door unlock circuit 32 remains open and the door is locked. As soon as triac T3 is turned off, switch 28 of external relay circuit 24 returns to position A enabling the door circuit to be unlocked if secondary switch 34 is closed.

Although the foregoing preferred embodiment includes a timer circuit, it is understood that the scope of the present invention extends to other suitable circuitry which would provide the necessary amplification and digital memory functions. Moreover, other suitable components may be substituted for those of the preferred system without departing from the present invention. It is also understood that the scope of the present invention includes other forms of sensing units for generating a signal indicative of the movement of the machinery requiring control. It is understood that various other changes, substitutions and alterations can be made in the preferred embodiment shown without departing from the spirit and scope of the present invention as defined by the appended claims:

What is claimed is:

1. A system for controlling a door lock to allow access to a rotatable cylinder only with said cylinder stationary, comprising:

magnetic means having a magnetic field and an induction coil for sensing rotational motion of said cylinder at velocities greater than a predetermined minimum rotational velocity to induce a pulse signal in said coil in response to the flux of said magnetic field as said cylinder rotates at velocities greater than said predetermined minimum rotational velocity;

circuitry means in electrical communication with said magnetic means for amplifying the pulse signal and for converting the signal to a DC control signal;

delay means in electrical communication with said circuitry means for maintaining the DC control signal for a predetermined period of time after the pulse signal ceases, said predetermined period of time being sufficient to enable the cylinder to transition from said predetermined minimum rotational velocity to a stationary position; and switch means responsive to the DC control signal for actuating and deactuating the cylinder door lock to control access to the rotatable cylinder.

2. The system of claim 1 wherein said magnetic means comprises a permanent magnet mounted with the induction coil on the axle of the rotatable cylinder adjacent a drive wheel for the rotatable cylinder so that movement of the drive wheel varies the magnetic flux of the permanent magnet to induce an AC voltage in the coil.

3. The system of claim 1 wherein the circuitry means includes a rectifier circuit for converting said pulse signal to a DC input signal, and a timer circuit for generating the DC control signal in response to the input signal.

4. The system of claim 1 wherein said delay means comprises a capacitor having a charging time corresponding to the predetermined period of time for maintaining the DC control signal at the input of the switch means after the input pulse signal has ceased until the capacitor has charged.

5. The system of claim 1 wherein said switch means comprises a transistor switch connecting an AC power supply to an electromagnetic relay in response to the DC control signal for deactuating a door unlock circuit while said cylinder is moving and for actuating the door unlock circuit when the DC control signal has ceased indicating that the rotatable cylinder is stationary.

6. A system for operating a relay to control a door lock for a laundry machine having a rotatable cylinder with a drive wheel having multiple spokes radiating from a common hub, comprising:

a permanent magnet mounted in magnetic communication with said hub and adjacent to said wheel to provide a path of magnetic flux along each wheel spoke as it passes immediately adjacent to said magnet;

an electrical pick-up coil mounted coaxial with said permanent magnet on the hub for intercepting said flux path and inducing a pulse signal in response to variations of said flux path;

a rectifier circuit in electrical communication with the pick-up coil to convert the pulse signal to a steady-state DC signal;

a digital circuit having a bistable multivibrator and an amplifier circuit for providing a digital control signal;

a transistor circuit in communication with the output of said rectifier circuit and the input of said ditital circuit to actuate said digital circuit in response to the steady-state DC signal; and an electronic switch in communication with the output of the digital circuit and in communication with a power supply to connect the power supply across the terminals of the relay in response to the digital output signal to thereby actuate said relay.

7. Electrical circuitry for monitoring an AC input signal to operate a relay, comprising in combination:

conversion means for rectifying and smoothing the AC input signal to provide a steady-state DC signal;

actuable digital means for generating a digital control signal;

transistor means for actuating said digital means in response to the steady-state DC signal;

switching means responsive to said control signal to impress an operating voltage across said relay; and control means for maintaining said control signal at the imput of said switching means for a predetermined period of time after the AC input signal has stopped.

8. The circuitry of claim 7 wherein said digital means comprises a bistable electrical device for switching states in response to said transistor means and said control means.

9. The circuitry of claim 7 wherein said switching means comprises a triac connected to a power supply to impress the supply across the relay terminals in response to the control signal.

10. The circuitry of claim 7 wherein said control means comprises a capacitor connected to charge from a biasing voltage when said AC input signal has stopped and having a charging time corresponding to said predetermined period of time.

11. A system for controlling a door lock for a laundry machine including a rotatable cylinder having a drive wheel with multiple spokes radiating from a common hub, conprising:

a permanent magnet mounted in magnetic communication with said hub and adjacent to said wheel to provide a path of magnetic flux along each wheel spoke as it passes immediately adjacent to said magnet;

an electrical pick-up coil mounted coaxial with said permanent magnet on the hub for intercepting said flux path and inducing a pulse signal in response to variations of said flux path greater than a flux level corresponding to a predetermined minimum rotational velocity of said cylinder;

control circuitry in electrical communication with said pick-up coil for generating a DC control signal in response to said pulse signal and for maintaining said control signal for a predetermined period of time after the induced signal has ceased, said predetermined period of time being sufficient to enable the cylinder to transition from said predetermined minimum rotational velocity to a stationary position; and electronic switching means in electrical communication with said control circuitry for actuating said door lock in response to said DC control signal.

12. A control system for a laundry machine having a rotatable cylinder, an electrical door unlocking circuit and an electrical extract circuit for controlling the high-speed extract cycle of the cylinder, comprising:

magnetic means for sensing rotation of said cylinder and generating a sensing signal;

control circuitry in electrical communication with said magnetic means for generating a control signal in response to said sensing signal; and electronic switching means in electrical communication with said control circuitry for deactuating said door unlocking circuit and actuating said extract circuit only in response to said control signal.

13. A system for controlling a door lock to allow access to a rotable cylinder only with said cylinder stationary, comprising:

magnetic means having a magnetic field and an induction coil for sensing movement of said cylinder to induce a pulse signal in said coil;

circuitry means in electrical communication with said magnetic means for amplifying the pulse signal and for converting the signal to a DC control signal;

delay means in electrical communication with said circuitry means for maintaining the DC control signal for a predetermined period of time after the pulse signal ceases, said delay means comprising a capacitor having a charging time corresponding to the predetermined period of time for maintaining the DC control signal at the input of the switch means after the input pulse signal has ceased until the capacitor has charged; and switch means responsive to the DC control signal for actuating and deactuating the cylinder door lock to control access to the rotatable cylinder.

14. A system for controlling a door lock to allow access to a rotatable cylinder only with said cylinder stationary, comprisings:

magnetic means having a magnetic field and an induction coil for sensing movement of said cylinder to induce a pulse signal in said coil;

circuitry means in electrical communication with said magnetic means for amplifying the pulse signal and for converting the signal to a DC control signal;

delay means in electrical communication with said circuitry means for maintaining the DC control signal for a predetermined period of time after the pulse signal ceases; and switch means responsive to the DC control signal for actuating and deactuating the cylinder door lock to control access to the rotatable cylinder, said switch means comprising a transistor switch connecting an AC power supply to an electromagnetic relay in response to the DC control signal for deactuating a door unlock circuit while said cylinder is moving and for actuating the door unlock circuit when the DC control signal has ceased indicating that the rotatable cylinder is stationary.

15. A system for generating a control signal in response to motion by a movable magnetizable member comprising:

stationary structure in magnetic communication with said movable member;

a permanent magnet mounted on said structure adjacent said movable member so that the member cuts across the magnetic field of the permanent magnet;

a pick-up coil mounted on said structure coaxial with said magnet to generate an induced voltage as the moving member cuts across the magnetic field; and circuit means for converting the induced voltage to said control voltage, including multiple-state memory means to provide a steady-state output in response to the induced voltage, and delay means for continuing said steady-state output for a predetermined time period after the induced voltage ceases;

said multiple-state memory means including a bistable multivibrator circuit in communication with the pick-up coil to switch between a first and second status in response to the presence and absence, respectively, of the induced voltage signal, and said delay means including a capacitor which is connected to a biasing voltage when the induced voltage ceases and which has a charging time corresponding to said predetermined delay time.

* * * * *